US005672291A

United States Patent [19]

Han

[11] Patent Number: 5,672,291

[45] Date of Patent: Sep. 30, 1997

[54] APPARATUS FOR ROTATING A TURNTABLE OF A MICROWAVE OVEN AND VERTICALLY ADJUSTING THE TURNTABLE BY A SINGLE MOTOR

[75] Inventor: Suk-Jin Han, Suwon, Rep. of Korea

[73] Assignee: Samsung Electronics Co., Ltd., Suwon, Rep. of Korea

[21] Appl. No.: 664,665

[22] Filed: Jun. 17, 1996

[30] Foreign Application Priority Data

Jun. 15, 1995 [KR] Rep. of Korea ..... 95-13574 U
Apr. 25, 1996 [KR] Rep. of Korea ..... 96-12984

[51] Int. Cl.[6] ..... H05B 6/78

[52] U.S. Cl. ..... 219/753; 219/754; 219/762

[58] Field of Search ..... 219/753, 752, 219/754, 755, 762; 108/20, 139, 138; 126/338; 99/443 R, DIG. 14

[56] References Cited

U.S. PATENT DOCUMENTS 3,436,506 4/1969 Smith ..... 219/753
4,286,133 8/1981 Einset et al. ..... 219/753
4,725,703 2/1988 Park ..... 219/753
4,757,173 7/1988 Park ..... 219/753

FOREIGN PATENT DOCUMENTS 1-150396 10/1989 Japan .

*Primary Examiner*—Philip H. Leung
*Attorney, Agent, or Firm*—Burns, Doane, Swecker & Mathis, L.L.P.

[57] ABSTRACT

A microwave oven includes a cooking chamber and a turntable disposed therein for supporting food. The turntable is rotatable about an axis and is vertically adjusted. A single reversible motor performs both functions of rotating and vertically adjusting the turntable due to a power transmission mechanism which connects the motor to the turntable and rotates the turntable in response to the motor being driven in a first direction, and for vertically moving the turntable in response to the motor being driven the opposite direction.

11 Claims, 5 Drawing Sheets

APPARATUS FOR ROTATING A TURNTABLE OF A MICROWAVE OVEN AND VERTICALLY ADJUSTING THE TURNTABLE BY A SINGLE MOTOR

BACKGROUND OF THE INVENTION

1. Field of the Invention

The present invention relates to a turn table driving apparatus of a microwave oven, and more particularly to a turn table driving apparatus of a microwave oven for selectively rotating or vertically adjusting a turn table direction to thereby enable a speedier and more uniform cooking.

2. Description of the Prior Art

Generally, a microwave oven is formed as illustrated in FIG. 1, with a heating chamber 2 employing a predetermined space therein in order to accommodate food in a case 1 serving as an enclosure of the microwave oven and at the same time to heat the food.

The heating chamber 2 is provided at an upper surface thereof with a stirrer blade 5 rotatatively mounted in a stirrer cover 3 on an axis 4 so that high frequency waves can be dispersed to evenly heat the food.

The stirrer blade 5 communicates at an upper side thereof with a waveguide 6 so that the high frequency waves can be dispersed by the stirrer blade 5 to thereby be guided into the heating chamber 2.

The waveguide 6 is provided at one end thereof with a magnetron 7 for receiving a high voltage electric power from power supply means (not shown) to thereby generate high frequency.

The case 1 is provided at one side therein with a cooling fan 8 for cooling the magnetron 7 by way of a blowing power generated thereby and at the same time for rotating the stirrer blade 5.

The heating chamber 2 is provided on an inner floor side thereof with a cooking table for accommodating the food, preferably a turn table 9 for placing a vessel thereon. The heating chamber 2 is provided on an external floor side thereof with driving means 10 for receiving an electric power to rotate the turn table 9.

In the conventional microwave oven thus constructed, when a manipulating switch (not shown) is manipulated after a food vessel is put on the turntable 9 disposed in the heating chamber 2, the magnetron 7 serves to receive a high voltage electric power and to oscillate for the generation of high frequency, which is in turn guided into the stirrer cover 3 along the waveguide 6, and at the same time, to the stirrer blade 5 rotatable mounted in the stirrer cover 3.

At this time, the stirrer blade 5 is rotated by the blowing power of the cooling fan 8 for evenly dispersing and supplying into the heating chamber 2 the high frequency waves thereby dielectrically heating the food.

At the same time, the turn table 9 is rotated by the driving means 10 so that the food on the turn table 9 is scanned by the high frequency waves and the food thereon is dielectrically heated still faster.

However, there is a problem in a turn table driving apparatus of a microwave oven thus constructed in that vertical adjustment of the turn table cannot be effected to allow a vertical position of the food inserted into the heating chamber 2 to be adjusted for a better use of space in the heating chamber 2 and for an effective cooking of the food.

As a prior art to prevent the problem encountered by the conventional turn table driving apparatus, Japanese laid open utility model application number Hei Sei 1-150396 has been disclosed.

The turn table driving apparatus disclosed in the Japanese utility model No. Hei Sei 1-150396 is constituted, as illustrated in FIG. 2, by rotary means 20 for rotatatively operating the turn table 9 and vertically adjusting means 30 for vertically adjusting the turn table 9 by way of a linkage.

In other words, the turn table rotary means 20 is provided at an inner floor side of the case cover 1 with a first motor 21 for being activated by electric power, where the first motor 21 is fixedly coupled at an upper side thereof with a driving coupling 22.

The driving coupling 22 is coupled by a serrations to driven coupling 23 projecting downwardly from a central bottom surface of the turn table 9 to thereby pass through a floor surface of the heating chamber 2.

Meanwhile, the vertically adjusting means 30 is provided with first and second sliding rods 33 and 34 respectively guided by first and second guide members 31 and 32 formed on the floor of the heating chamber 2 so as to support and to vertically adjust the turn table 9.

The first and second sliding rods 33 and 34 are provided at lower ends thereof with first and second left link members **35*a* and 35*b* and first and second right link members 36*a* and 36*b* which are hinge-coupled so that the first sliding rod 33 and the second sliding rod 34** can be restrained in their vertically moving distances.

A hinged portion where the first and second left link members **35*a* and 35*b* and the first and second right link members 36*a* and 36*b* are connected is, in turn, hinge-coupled to a horizontally moving line member 37 for driving the link members 35*a*, 35*b*, and 36*b***.

A hinge-coupled portion where the first and second right link members **36*a* and 36*b* are connected is hinge-coupled to a driving link member 38 which horizontally moves the horizontally moving link member 37**.

The driving link member 38 is connected at the other end thereof to a worm wheel 40 having a cam 39 so as to convert a rotary movement of the driving link member 38 to a reciprocating movement.

The worm wheel 40 is meshed with a worm 42 connected to a second motor 41.

Reference numeral 50 in the drawing represents detecting means disposed at one side of floor surface in the heating chamber 2 adjacent to the first guide member 31 so as to detect a vertical position of the turn table 9.

In the turn table driving apparatus of a microwave oven thus constructed, when manipulating means (not shown) is manipulated to thereby activate the second motor 41, the second motor 41 serves to receive an electric power to thereby be activated and to rotate the worm 42 fixed to a motor axis.

The worm serves to rotate the worm wheel 40 meshed therewith, and, at the same time, to drive the cam 39 integrally fixed to the worm wheel 40, so that the cam 39 can reciprocate the driving link member 38.

At this time, the driving link member 38 serves to reciprocate the link member 37 and the link member 37 serves to rotate the first and second left link members **35*a* and 35*b* and the first and second right link members 36*a* and 36*b***.

When the first and second lift link members **35*a* and 35*b* and the first and second right link members 36*a* and 36*b* are simultaneously rotated, the first and second sliding rods 33 and 34 are vertically moved to vertically adjust the turn table 9** disposed thereupon.

When the turn table 9 reaches a desired height in the heating chamber 2, the second motor 41 is stopped according to a signal from the detecting means 50, and the turn table 9 is rotated at the desired height by the first motor 21.

However, there is a problem in the conventional turn table driving apparatus of a microwave oven thus constructed, in that the structure thereof is complicated and the apparatus can easily get out of order because it utilizes a worm drive and a plurality of links.

Furthermore, there is another problem in that friction noise can be generated and an accurate 3-point support of the turn table is difficult to achieve due to the sliding rods 33 and 34 being abraded by the turn table 9 when the turn table 9 is rotatively driven.

SUMMARY OF THE INVENTION

Accordingly, the present invention is disclosed to solve the afore-mentioned problems and it is an object of the present invention to provide a turn table driving apparatus of a microwave oven for selectively rotating or vertically adjusting a turn table by means of a plurality of gear transmission means and power converting means working in cooperation with a bi-directional motor, and for reducing manufacturing cost thereof by simplifying its structure and decreasing the number of parts involuted therewith.

In accordance with the present invention, this object can be accomplished by providing a turn table driving apparatus of a microwave oven, where a turn table axle is rotated or vertically moved according to the direction of rotation of a driving source, the apparatus comprising: a rotary gear for rotating the turn table axle;

feeding means for vertically moving the turn table axle;

a bi-directional motor for selectively driving the rotary gear and the feeding means; and power transmission means for selectively transmitting an electric power to the rotary gear and to the feeding means according to the rotary direction of the bi-directional motor.

BRIEF DESCRIPTION OF THE DRAWINGS

For a fuller understanding of the nature and objects of the invention, reference should be made to the following detailed description taken in conjunction with the accompanying drawings in which:

FIG. 3 is a plan view of a turn table driving apparatus according to the present invention;

FIG. 4 is a longitudinal sectional view taken along line 4—4 of FIG. 3 for illustrating a lowest position of a turn table, FIG. 5 is a view similar to FIG. 4 illustrating a highest position of the turn table, FIG. 6 is a longitudind sectional view taken along line 6—6 of FIG. 3, FIG. 7 is a longitudinal sectional view taken along line 7—7 of FIG. 3 for illustrating a vertical adjustment of the turn table, FIG. 8 is a view similar to FIG. 7 for illustrating rotation of the turn table, and FIG. 9 is a cam diagrammatic view for illustrating a state where the turn table according to the present invention is moved up and down.

DETAILED DESCRIPTION OF PREFERRED EMBODIMENTS OF THE INVENTION

Figure 1:
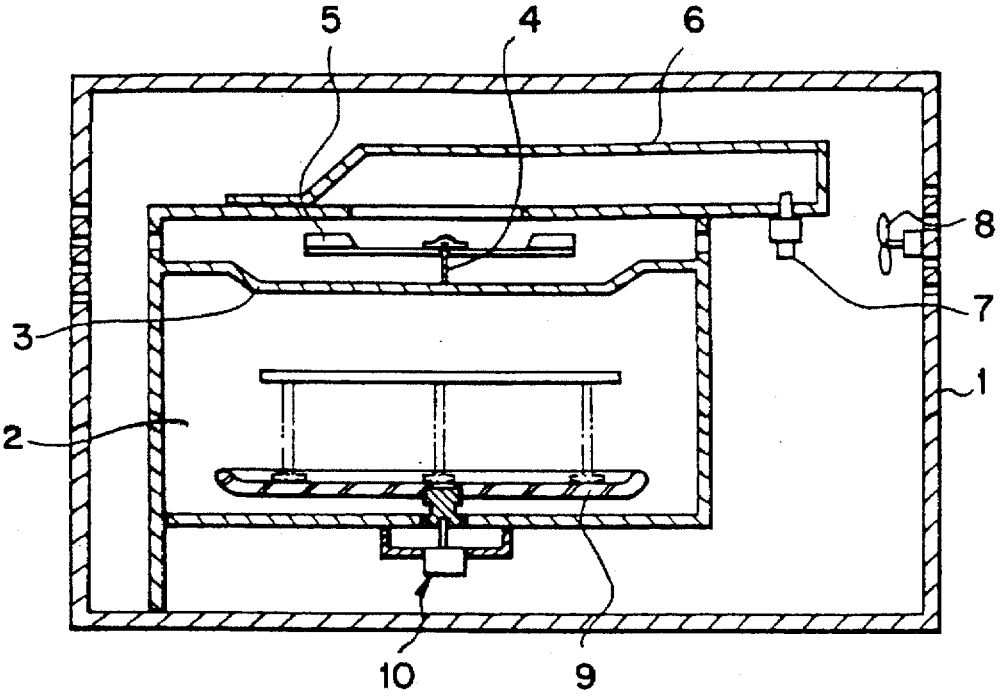
FIG. 1 (PRIOR ART)
FIG. 1 is a longitudinal sectional view for schematically illustrating a prior art microwave oven.
Figure 2:
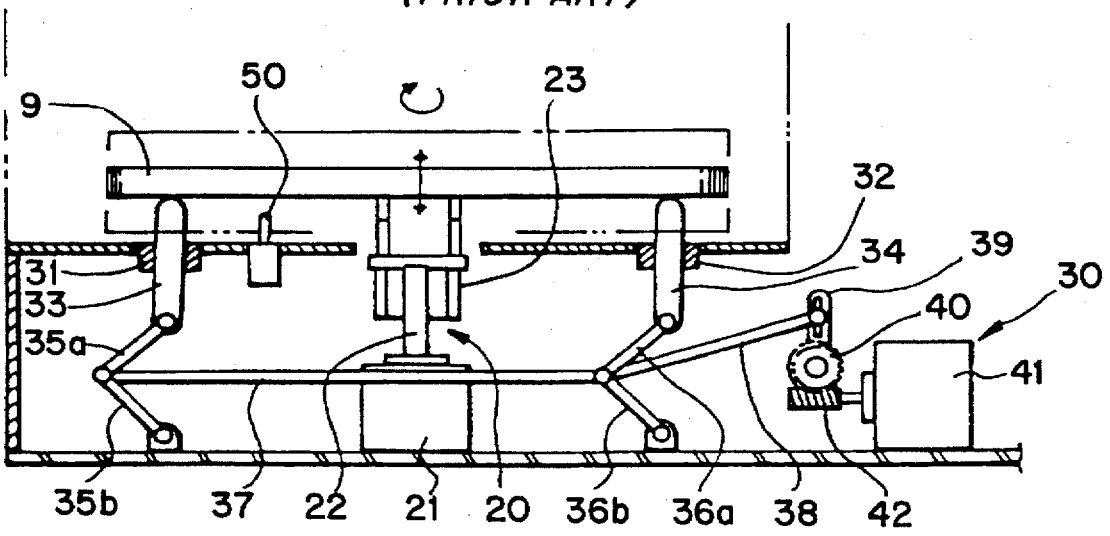
FIG. 2 (PRIOR ART)
FIG. 2 is a longitudinal sectional view for illustrating a turn table driving apparatus of a microwave oven according to the prior art.
Figure 3:
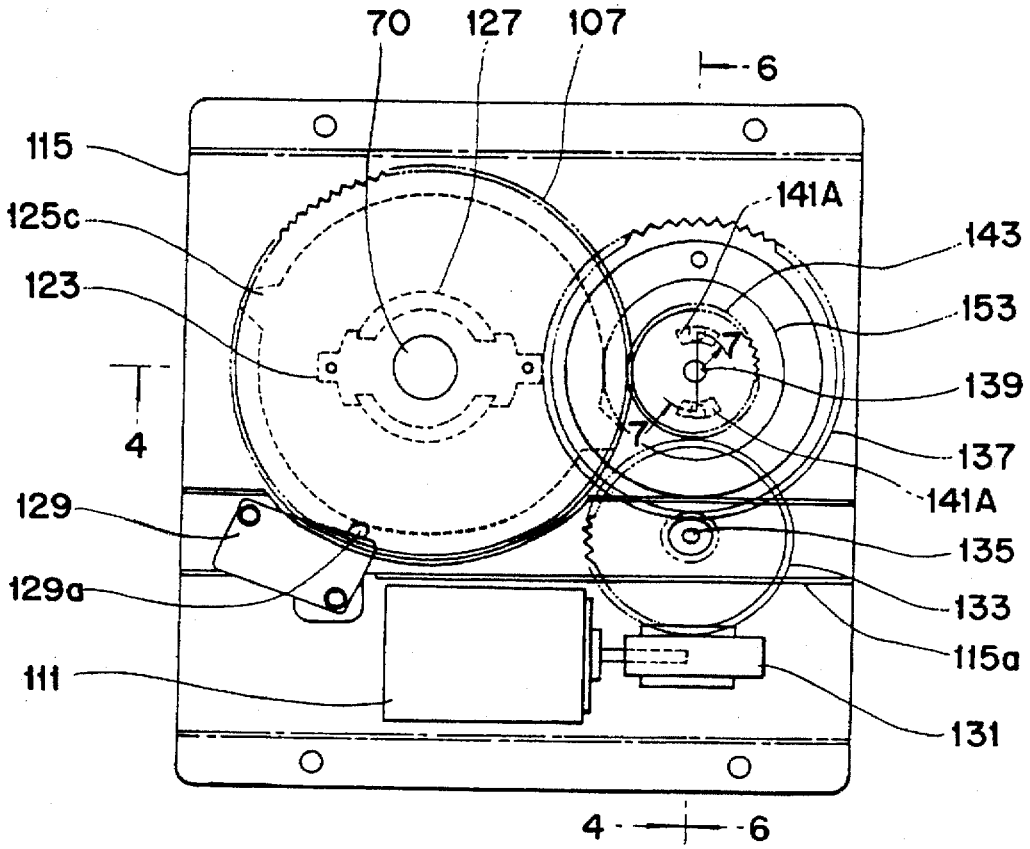
FIGS. 3 through 9 are drawings for illustrating a first embodiment of the present invention where.

The first embodiment of the present invention will now be described in detail with reference to FIGS. 3–9.

Throughout the drawings, like reference numerals and symbols are used for designation of like or equivalent parts or portions for simplicity of illustration and explanation, and a detailed description thereof are omitted.

In FIGS. 3 through 9, a turn table driving apparatus includes a body 60 disposed underneath the beating chamber 2, a turn table axle 70 for rotating and vertically moving the turn table 9, turn table rotating means 80 to rotate the turn table 9, and turn table vertical movement means 90 to vertically move the turn table 9.

The axle 70 is releasable coupled to the turn table 9 positioned thereabove.

The turn table axle 70 is slidingly mounted in a rotary gear 107 for rotating the turn table axle 70.

The turn table axle 70 has a lower end mounted to feeding means 109 for vertically moving the turn tabler axle 70.

Furthermore, the body 60 is provided with a bi-directional motor 111 for driving the rotary gear 107 and the feeding means 109.

The bi-directional motor 111 is provided at one side thereof with power transmission means 113 for transmitting power to the rotary gear 107 and the feeding means 109.

At this time, the body 60 is constituted as an enclosure by including a base plate 115 and a cover member 117, where the base plate 115 is screwed to the cover member 117 by a plurality of fastening members 119.

In other words, the base plate 115 takes an approximate rectangular form, a central portion of which is provided with a multi-faced embossing unit **115*a*** to support gears at a predetermined height.

The cover member 117 has an open bottom side.

The cover member 117 is formed at both ends thereof with flange units **117*a* and 117*b* connected to the base plate by the fastening members 119**.

The cover member 117 is formed at an upper side thereof with a sleeve 117C through which the turn table axle 70 can pass.

The cover member 117 is provided with a bent flange **117*d* of "L" shape in a cross-sectional view thereof, which faces the embossing unit 115*a* of the base plate 115, so that the gears of the power transmission means 113** can be installed at the predetermined height.

Meanwhile, the turn table axle 70 has a polygonal or serrated shape and is sliding mounted with the rotary gear 107.

The turn table axle 70 is formed at both ends thereof with a "D" shape so as to be fitted into the turn table 9 and the feeding means respectively.

The turn table axle 70 is slidingly coupled with the rotary gear 107 so that it can receive the turning effect from the rotary gear 107.

The turn table axle 70 is coupled at a lower end thereof with a padding member (described later) of the feeding means 109 so as to receive a vertical force from the feeding means 109.

The rotary gear 107 is meshed with the power transmission means 113 within the body 60.

The padding means 121 of the feeding means is disposed underneath the turn table axle 70, and the padding means 121 is provided at an external side thereof with a lifting member 123 for lifting the padding member 121.

The lifting member 123 is arranged on a lifting drive member 125 for lifting the lifting member 123.

Furthermore, the lifting member 123 is slidably mounted on fingers 127A of a guide member 127 for restraining rotation of the lifting member 123 and for guiding the lifting thereof and a sensor 129 is provided for detecting a rotated position of the lifting drive member 125 (and thus detecting the height of the turntable).

The padding member 121 is shaped like a vessel having a flange unit 121*a* seated on the lifting member 123 and is centrally accommodated with a lower end unit of the turn table axle 70 in order to support the turn table axle 70.

The lifting drive member 125 includes an undulating cam driving surface 125*a* to lift the lifting member 123 up and down, and a gear unit 125*b* meshed with the power transmission means 113.

The gear unit 125*b* is formed with a plurality of tripping jaws 125*c* (see FIG. 1) in order to enable the sensor 129 to detect a rotated position of the lifting drive member 125 tripping the sensor 129.

The sensor 129 is disposed at the base plate 115 of the body 60, where a protruded end 129*a* is to be contacted by the tripping jaw 125*c* of the lifting drive member 125 to thereby generate a detecting signal.

Meanwhile, the power transmission means 113 includes a first gear 131 coupled to a motor axis (not shown) of the bi-directional motor 111, and a second gear 133 meshed with the first gear 131 and mounted on a shaft 135.

A third gear 137 meshed with the second gear 133 is rotatatively arranged on an axle 139 between the base plate 115 of the body 60 and the cover member 117.

Furthermore, the third gear 137 shares a common axle 139 with a fourth gear 143 and a fifth gear 145 so that the turning of the third gear 137 can be transmitted to the rotary gear 107 (via gear 143) or to the lifting drive member 125 (via gear 145) in response to actuation of a plurality of power switching means 141 (to be described).

The second gear 133 is provided between a boss 115*a* of the body 60 and the bent flange 117*d*.

The first gear 131 is worm-shaped in order to increase a reduction gear ratio.

The third gear 137 is provided with a plurality of through holes 141A at a predetermined spacing from a rotational axis of the gear, to receive the plurality of power switching means 141. A cover member 153 is fixed to gear 137.

Figure 7:
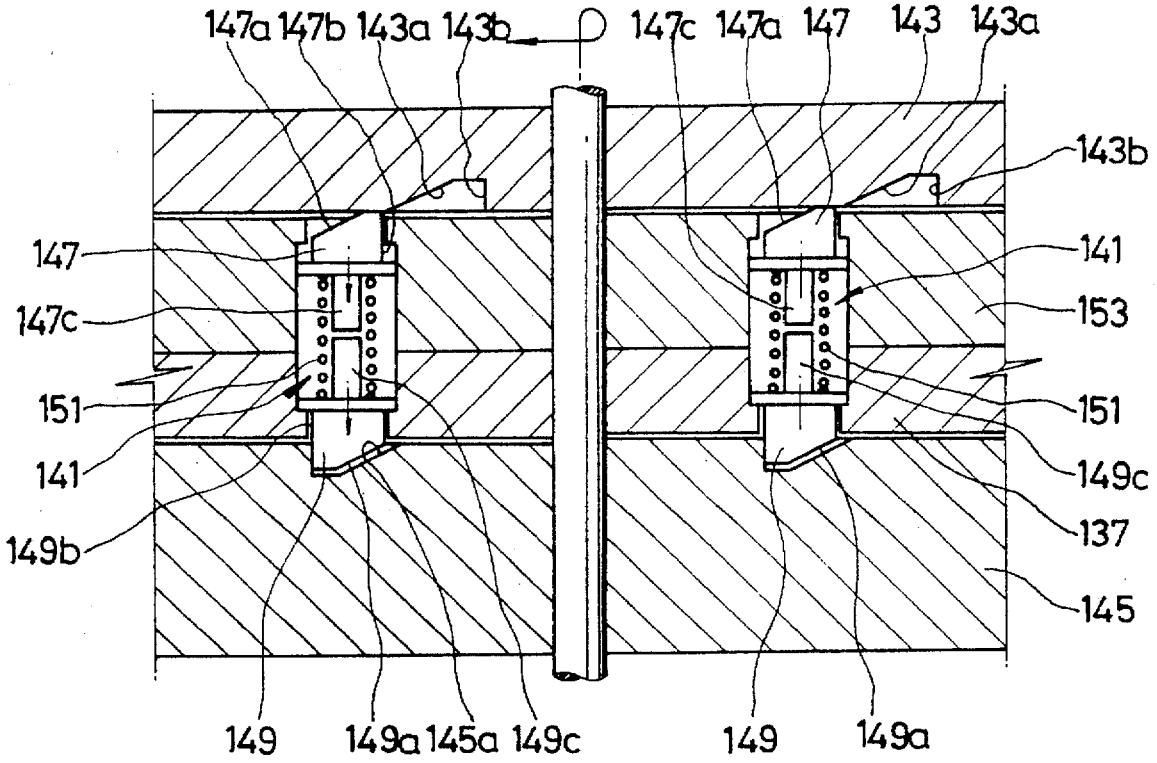
Figure 8:
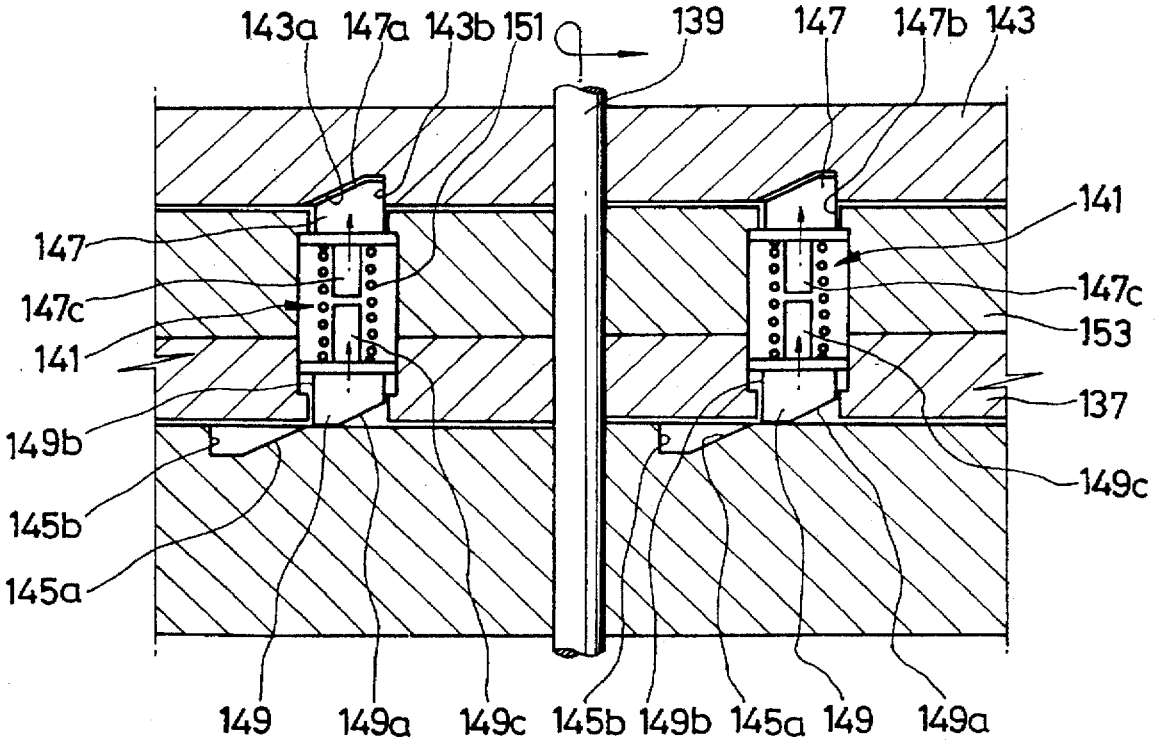

Each of the power switching means 141 disposed in gear 137, as illustrated in FIGS. 7 and 8, includes upper and lower locks 147 and 149 disposed for vertical movement to couple the third gear 137 with either: (i) the fourth gear 143, so that the fourth gear 143 can be rotated when the bi-directional motor is driven in normal direction to thereby rotate the turn table axle 70, or (ii) the fifth gear 145 so that the gear 145 can be rotated when the bi-directional motor 111 is driver in a reverse direction to thereby vertically move the turn table axle 70. A spring 151 is mounted between the upper lock 147 and the lower lock 149 so that ends of the upper lock 147 and the lower lock 149 can be always contacted to the fourth gear 143 or the fifth gear 145 by resilient force.

An upper end of the upper lock 147 can extend into the fourth gear 143, or a lower end of the lower lock 149 can extend into the fifth gear.

Furthermore the set of upper and lower locks 147 and 149 are respectively formed with inclined faces 147*a* and 149*a* which can slide on inclined surfaces 143*a* and 145*a* respectively formed on the forth gear 143 and the fifth gear 145 depending upon the direction of rotation of the third gear 137.

Vertical surfaces 147*b* and 149*b* of the upper and lower locks 147, 149 face vertical surfaces 143*b* and 145*b* respectively formed in the fourth gear 143 and the fifth gear 143.

Protruding stems 147*c* and 149*c* for supporting both ends of the spring 151 are respectively formed on the upper lock 147 and the lower lock 149.

Hereinafter, the operation of the first embodiment of the present invention thus constructed will be described in detail.

Figure 4:
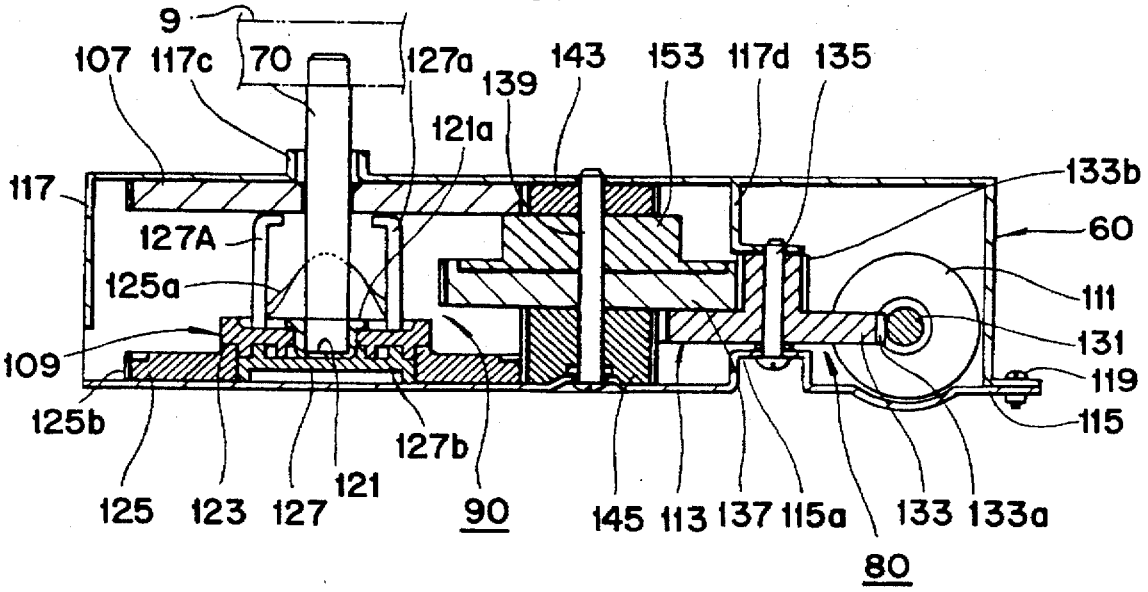

As illustrated in FIG. 4, when lifting member 123 of the feeding means 109 is lowered and the motor axis of the bi-direction motor 111 is rotated in one direction by manipulating means (not shown) rotation of the bi-direction motor 111 is sequentially transmitted to the second gear 133 and to the third gear 137 through the first gear 131 fixed on the motor axis, and the feeding means 109 is operated by the power switching means 141 according to the direction of rotation of the third gear 137.

In other words, when the third gear 137 is rotated to the left around axle 139, as illustrated in FIG. 7, the upper and lower locks 147 and 149 are simultaneously rotated to the left with the third gear 137.

The locks 147 and 149 are simultaneously biased vertically by the resilient force of the spring 151 whereby the locks 147 and 149 contact a lower surface of the fourth gear 143 and an upper surface of the fifth gear 145, respectively.

At this time, the inclined surface 147*a* of the upper lock 147 is cammed downwardly by the inclined surface 143*a* of the forth gear 143.

Therefore, the fourth gear 143 is not rotated when the third gear 137 is rotated.

However, the vertical surface unit 149*b* of the lower lock 149 drivingly engages the vertical surface 145*b* of the fifth gear 145.

The fifth gear 145 is then simultaneously rotated when the third gear 137 is rotated, and the lifting drive member 125 of the feeing means 109 is rotated in one direction according to the rotation of the fifth gear 145.

Therefore, the lifting member 123 is moved upwardly.

The padding member 121 slidingly and snugly disposed in the lifting member 123 is also simultaneously moved upwards and the turn table axle 70 supported by the padding member 121 is moved upwards through the through hole formed in the rotary gear 107, thereby moving up upwards the turn table 9 fixed to an upper end unit of the turn table axle 70.

At this time, the tripping jaw 125*c* of the lifting drive member 125 trips a protruding end of the sensor 129, to thereby detect a rotational position of the lifting drive member 125 and thus a height of the turntable.

Figure 5:
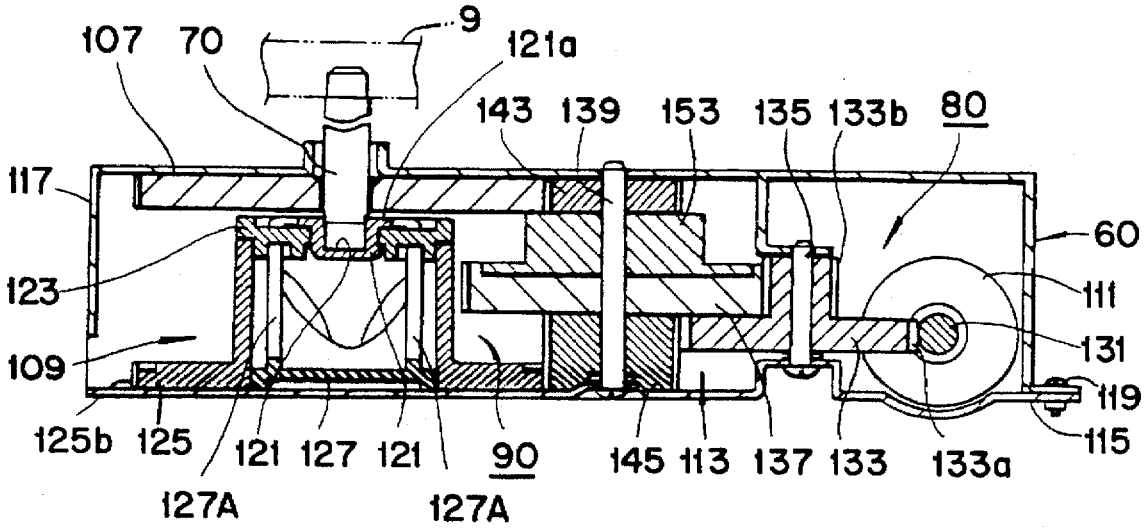
Figure 6:
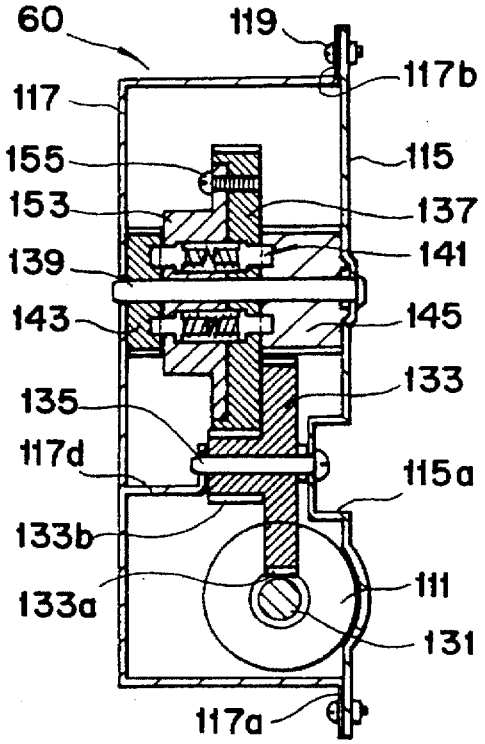
Figure 9:
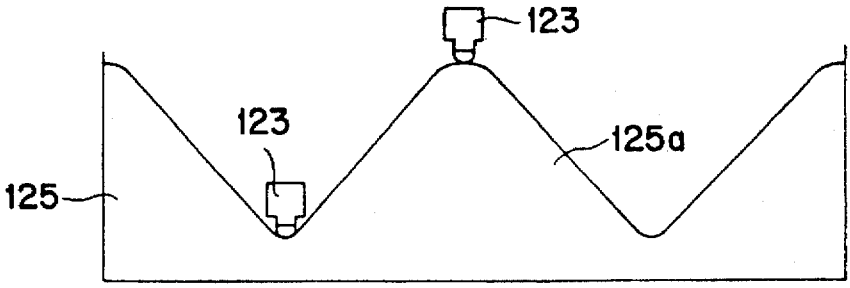

In other words, as illustrated in FIG. 9, when the lifting member 123 is positioned on a ridge of the undulating upper surface 125*a*, the bi-directional motor 111 is stopped by the control means and the lifting drive member 125 and lifting member 123 maintain raised positions as shown in FIG. 5.

Meanwhile, when the motor axis of the bi-directional motor 111 is caused to rotate in a reverse direction by way of the manipulating means, the power switching means 141 is operated in the reverse direction to thereby operate the rotational gear 107.

In other words as illustrated in FIG. 8, when the third gear 137 is rotated to the right around the gear axle 139, the upper and lower locks 147 and 149 are simultaneously rotated to the right.

At this time, the lower lock 149 is disposed upwardly when the inclined surface 149*a* formed at one end thereof contacts the inclined surface 145*a* of the fifth gear 145, so that the fifth gear 145 is not rotated when the third gear 137 is rotated.

However, vertical surface 147*b* formed at an end of the upper lock 147 engages the vertical surface unit 143*b* formed in an upper side of the fourth gear 143 to drive the latter.

The fourth gear 143 is then rotated and the rotational gear 107 meshed with the fourth gear 143 is rotated.

At this time, the turn table axle 70 is rotated at a predetermined speed.

As is apparent from the foregoing, there is an advantage in the turn table driving apparatus of a microwave oven according to the first embodiment, in that a plurality of gears are selectively driven according to the rotational direction of the bi-directional motor 111 to thereby rotate or lift up and down the turn table axis 90, so that the structure thereof is simple and only one motor is used thereto to reduce the manufacturing cost thereof.

Next, a second embodiment of the present invention will be described with reference to FIG. 10.

Figure 10:
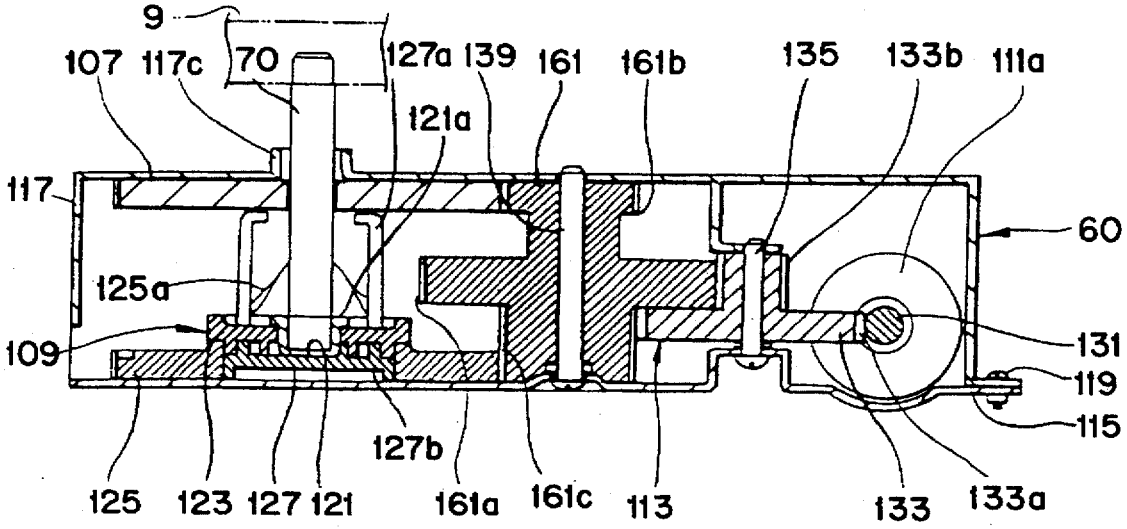
FIG. 10 is a view similar to FIG. 5 of a second embodiment of the present invention.

Throughout the drawing in FIG. 10, like reference numerals and symbols are used for designation of like or equivalent parts or portions for simplicity of illustration and explanation, and detailed description thereof will be omitted therefore.

In FIG. 10, the power transmission means includes a first gear 131 coupled to a motor axis (not shown) of a unidirectional motor, and a second gear 133 is meshed with the first gear 131.

A third gear 161 is arranged in the body 60 so that turning of the second gear 133 can be transmitted to the rotational gear 107 and to the lifting drive member 125.

Furthermore, the third gear 161 is formed with first gear teeth 161*a* meshed with the second gear 133, second gear teeth 161*b* meshed with the rotational gear 107 and third gear teeth 161*c* meshed with the lifting drive member 125.

In the turn table driving apparatus according to the second embodiment of the present invention thus constructed, the third gear 161 is rotated by the second gear 133 in response to rotation of the unidirectional motor 111*a*, and the gear 161 serves to rotate the turn table axle 70 when the rotational gear 107 and the lifting drive member 125 are simultaneously rotated by the third gear 161.

The lifting drive member 125 serves to lift up and down the turn table axle 70 disposed on the padding member 121 as the lifting member 123 is lifted up and down, so that the turn table 9 fixed to the upper end of the turn table axle 70 can be rotated and lifted up and down at the same time.

As is apparent from the foregoing, there is an advantage in the turn table driving apparatus of a microwave oven according to the second embodiment of the present invention, in that a plurality of gears are simultaneously and rotatatively driven in the same direction according to rotational direction of the unidirectional motor 111*a*, to thereby and lift up and down the turn table axle 70, such that the structure thereof can be simple to reduce manufacturing cost thereof.

What is claimed is:

1. A microwave oven comprising:

a cooking chamber including a floor;

a turntable fixed to an axle extending through the floor;

a bi-directional motor having an output shaft; and a power transmitting mechanism connected between the motor and the axle for rotating the axle in response to rotation of the output shaft in a first direction, and for moving the axle vertically in response to rotation of the output shaft in an opposite second direction, the power transmitting mechanism including a gear operably connected to the axle for rotating the axle during rotation of the output shaft in the first direction.

2. The microwave oven according to claim 1 wherein rotation of the output shaft in the second direction produces upward movement of the axle until the axle reaches a maximum height, whereupon the axle moves downward until reaching a minimum height.

3. The microwave oven according to claim 1, wherein the power transmission mechanism includes a rotary drive element connected to the output shaft to be rotated thereby about an axis; the driven element rotating in one direction in response to rotation of the output shaft in the first direction, and rotating in an opposite direction in response to rotation of the output shaft in the second direction; the rotary drive element including first and second axially spaced sides; first and second rotary driven elements disposed adjacent the first and second sides, respectively, and rotatable about the axis; the first driven element being operably connected to the axle for rotating the axle when the first driven element is rotated; the second driven element being operably connected to the axle for moving the axle vertically when the second driven element is rotated; the drive element including first and second locks elastically biased toward contact with surfaces of the first and second driven elements, respectively; the locks and surfaces being shaped so that the first lock rotates the first driven element and the second lock is retracted away from the second driven element in response to rotation of the drive element in the one direction, and so that the first lock is retracted away from the first driven element and the second lock rotates the second driven element in response to rotation of the drive element in the opposite direction.

4. The microwave oven according to claim 1 further including a sensor for detecting a vertical height of the turntable and operably connected to the motor for deactivating the motor when the turntable is at a selected height.

5. The microwave oven according to claim 1 wherein the power transmission mechanism includes feeding means for vertically moving the axle, wherein the feeding means comprises:

a padding member fixed to a lower end of the turntable axle to support the turntable axle;

a lifting member disposed at an outer periphery of the padding member to vertically move the padding member;

a lifting drive member disposed under the lifting member to receive a power of the motor for vertically moving the lifting member;

a guide member disposed in the lifting drive member to restrict rotation of and to guide the vertical movement of the lifting member; and a sensor disposed at one side of the lifting drive member to detect a rotational position of the lifting drive member.

6. The microwave oven according to claim 5 wherein the lifting drive member comprises:

a driving member of cylindrical shape having an upper end surface thereof of undulating shape to vertically move the lifting member upon rotation thereof; and gear teeth formed at a periphery of the driving member and meshed with another gear of the power transmission mechanism.

7. The microwave oven according to claim 5 wherein the guide member is provided with a groove into which the lifting member is slidably inserted.

8. The microwave oven according to claim 5 wherein the power transmission mechanism comprises:

a first gear coupled to the bi-directional motor;

a second gear meshed with the first gear;

a third gear meshed with the second gear;

a fourth gear and a fifth gear respectively arranged at an upper and a lower side of the third gear, the fourth gear operably connected to the turntable axle for rotating the axle, the fifth gear operably connected to the axle for vertically moving the axle; and a plurality of power switching means mounted on the third gear for vertical movement so that rotary movement of the third gear can be selectively transmitted to the fourth and fifth gears.

9. The microwave oven according to claim 8 wherein the plurality of power switching means comprises:

a set of upper and lower locks disposed for vertical movement so that the fourth gear can be rotated by one of the locks when the output shaft of the bi-directional motor is driven in the first direction to thereby rotate the turntable axle and to be released from the fifth gear;

the fifth gear being rotated by the other lock when the output shaft is driven in the second direction to thereby vertically move the turntable axle and to be released from the fourth gear, and a spring mounted between the upper lock and the lower lock so that ends of the upper lock and the lower lock are always biased toward a lower surface of the fourth gear and an upper surface of the fifth gear, respectively.

10. The microwave oven according to claim 9 wherein each of the upper and lower locks comprises:

an inclined surface unit for engaging an inclined surface formed at a lower surface of the fourth gear or an upper surface of the fifth gear when the third gear is rotated in one direction; and a vertical surface for engaging a vertical surface formed at the lower surface of the fourth gear or the upper surface of the fifth gear when the third gear is rotated in a reverse direction; and a protruding structure for supporting a respective end of the spring.

11. The microwave oven according to claim 1 wherein the power transmission means comprises:

a rotary gear for rotating the axle;

a lifting drive member for vertically moving the axle;

a first gear coupled to the unidirectional motor;

a second gear meshed with the first gear; and a third gear meshed with the second gear to transmit rotation of the second gear selectively to one of the rotary gear and the lifting drive member.

* * * * *